US007134888B2

(12) United States Patent
Fan

(10) Patent No.: US 7,134,888 B2
(45) Date of Patent: Nov. 14, 2006

(54) CONNECTOR WITH SHUTTER AND ELASTIC MEANS SUPPORTING THE SHUTTER

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/148,128

(22) Filed: Jun. 7, 2005

(65) Prior Publication Data

US 2006/0063407 A1 Mar. 23, 2006

(30) Foreign Application Priority Data

Sep. 17, 2004 (TW) ..... 93214871 U

(51) Int. Cl.
*H01R 13/44* (2006.01)

(52) U.S. Cl. ..... 439/137; 439/140

(58) Field of Classification Search ..... 439/137, 439/140, 607

See application file for complete search history.

(56) References Cited

U.S. PATENT DOCUMENTS 6,685,362 B1 * 2/2004 Burkholder et al. ..... 385/78
6,733,311 B1 * 5/2004 Kameda ..... 439/140
6,942,503 B1 * 9/2005 Yamaguchi et al. ..... 439/141

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical connector includes a housing (1) defining a mating cavity (13) in a mating face thereof; terminals (2) loaded in the housing and each having a contact portion (21) exposed in the mating cavity; a shutter (4) covering the mating cavity and capable of sinking into the mating cavity to expose the contact portions of the terminals; and an elastic means (3) disposed between the shutter and the housing and provided with a elongated shaft member (33) aslant extending into the mating cavity to support the shutter. The shaft member is capable of rotating to a state substantially flatly lying between the housing and the shutter by pressure of the sinking shutter and will urge the sunk shutter to return to cover the mating cavity.

15 Claims, 8 Drawing Sheets

CONNECTOR WITH SHUTTER AND ELASTIC MEANS SUPPORTING THE SHUTTER

BACKGROUND OF THE INVENTION

1. Field of the Invention

The present invention relates to an electrical connector with a shutter for use with a peripheral device or the like for a computer.

2. Description of Related Art

In peripheral devices for connection to computers, the connector portions of the peripheral devices are often exposed to the outside. It presents a problem that foreign matter may enter the exposed connector portion and adhere to electrical contacts therein. In addition, the electrical contacts in the connector may come into contact with the hands, in which case static electricity or the like can cause damage to electronic circuits, chips and the like in the peripheral device. To protect the electrical connector from foreign matter or static electricity unexpected, it may be provided with a shutter to cover connector.

U.S. Pat. No. 6,733,311 discloses such a connector with a shutter. In this connector, a shutter is provided to cover the connector, and this shutter slides inside the connector under pressure when the connector is plugged. The shutter of this connector covers the front surface of the connector by support of a coil spring erected between the shutter and the housing when not plugged in. As the spring is erected, it will still perform a sizable height between the shutter and the housing even after being compressed. That can't meet the ever-increasing requirement of minimization of electrical components.

To overcome above-motioned problems, a new connector with shutter having an improved mechanism for elastically supporting the shutter is desired.

SUMMARY OF THE INVENTION

An object of the present invention is to provide an electrical connector having a shutter and an elastic means for supporting the shutter, the elastic means occupying a very small space in height when compressed.

Accordingly, to achieve the above object, an electrical connector of present invention includes a housing defining a mating cavity in a mating face thereof; terminals loaded in the housing and each having a contact portion exposed in the mating cavity; a shutter covering the mating cavity and capable of sinking into the mating cavity to expose the contact portions of the terminals; and an elastic means disposed between the shutter and the housing and provided with a elongated shaft member aslant extending into the mating cavity to support the shutter. The shaft member is capable of rotating to a state substantially flatly lying between the housing and the shutter by pressure of the sinking shutter and will urge the sunk shutter to return to cover the mating cavity.

Other objects, advantages and novel features of the present invention will become more apparent from the following detailed description taken in conjunction with the accompanying drawings.

DETAILED DESCRIPTION OF THE INVENTION

Figure 1:
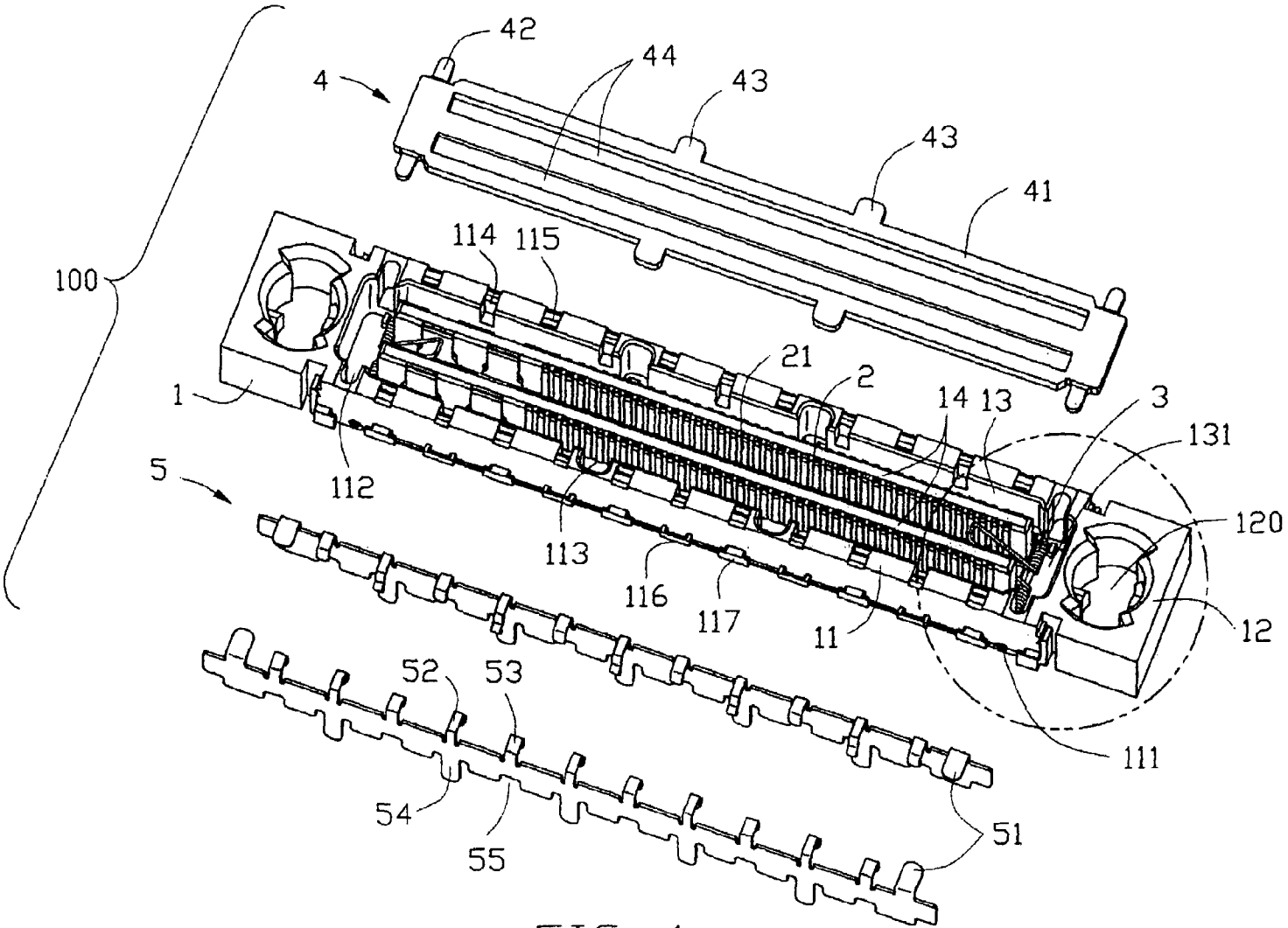
FIG. 1 is an exploded perspective view of an electrical connector having a shutter and an elastic means for supporting the shutter in accordance with a preferred embodiment of the present invention.
Figure 2:
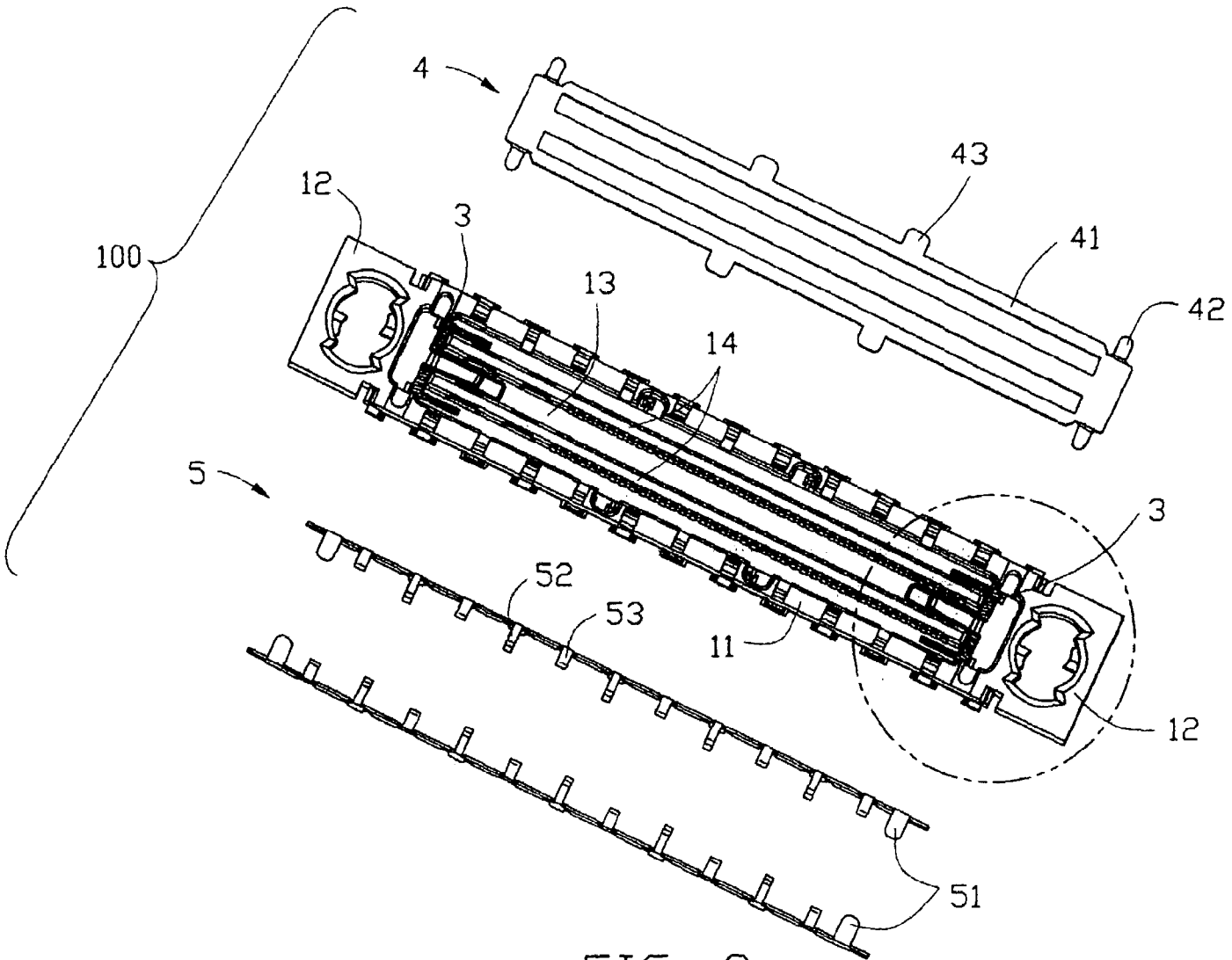
FIG. 2 is an exploded perspective view of the connector of FIG. 1 taken from a top perspective.

Reference will now be made to the drawing figures to describe the present invention in detail.

Referring to FIG. 1, an electrical connector 100 in accordance with the preferred embodiment of the present invention comprises a longitudinal housing 1, a plurality of terminals 2 loaded in the housing 1, a shutter 4 to cover the housing 1, an elastic means 3 for supporting the shutter 4, and a shielding shell 5 to be attached to a periphery of the housing 1.

The housing 1 comprises a main portion 11 and two end portions 12 along the longitudinal direction. Each end portion 12 defines a guiding hole 120 therein for guiding a mating connector. The main portion 11 defines a mating cavity 13 therein for receiving a mating portion of the mating connector. The mating cavity 13 has a pair of tongues 14 integrally protruding from a bottom 130 (shown in FIG. 5) thereof. The pair of tongues 14 parallel to each other along the longitudinal direction. Each of the terminals 2 loaded in the housing 1 has a solder foot 22 (shown in FIG. 3) extending down to be soldered to a printed circuit board (not shown), and a contact portion 21 attached to the tongue 14. The contact portions 21 are arranged on the side faces of the tongues 14, spaced from each other. In the mating cavity 13, there is a space by each longitudinal end of the tongues 14 to form a receiving room 131 for accommodating the elastic means 3.

Figure 7:
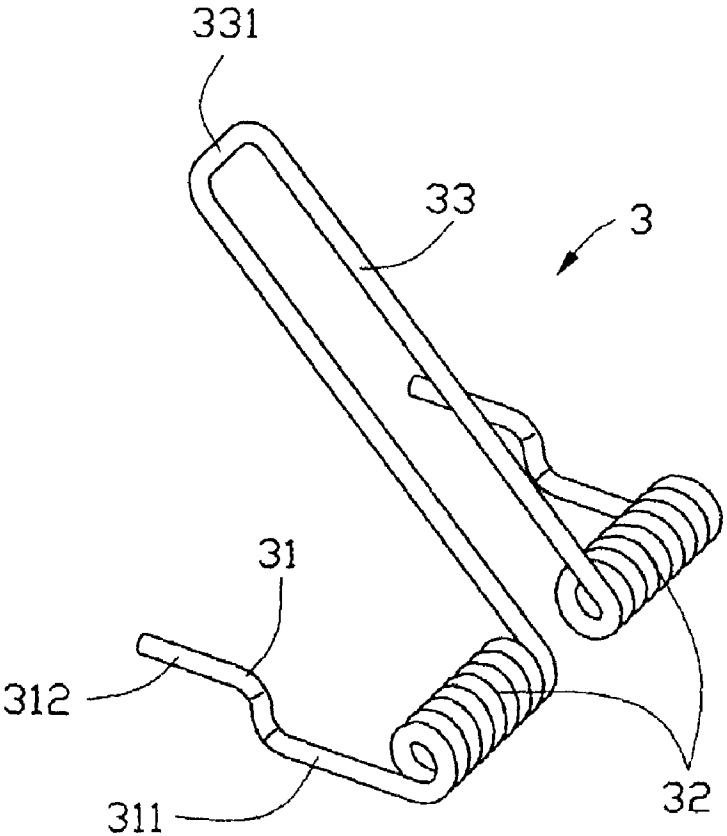
FIG. 7 is a perspective view showing the spring means of FIG. 1.

Referring to FIG. 7, the elastic means 3 comprises a retaining portion 31, an elastic portion 32, and a shaft member 33. The elastic portion 32 is a coil spring lying down in this preferred embodiment. Coiling of the coil spring 32 comes to a halt in the middle to form a II-shaped shaft member 33 which is straight protruding therefrom. That is to say that the coil spring 32 is configured into two coiled parts joined by the II-shaped shaft member 33. The retaining portion 31 is a pair of retaining legs parallel coming from two ends of the coil spring 32. The shaft member 33 and the retaining legs 31 are disposed at the same side of the coil spring 32, but the shaft member 33 aslant protruding upwards from a top of coils, the retaining legs 31 flatly coming from a bottom of coils. Each retaining leg 31 is bent into two parallel sections, wherein the end section 312 is leveled upper than the foot section 311 to a level of the top of the coils.

Figure 4:
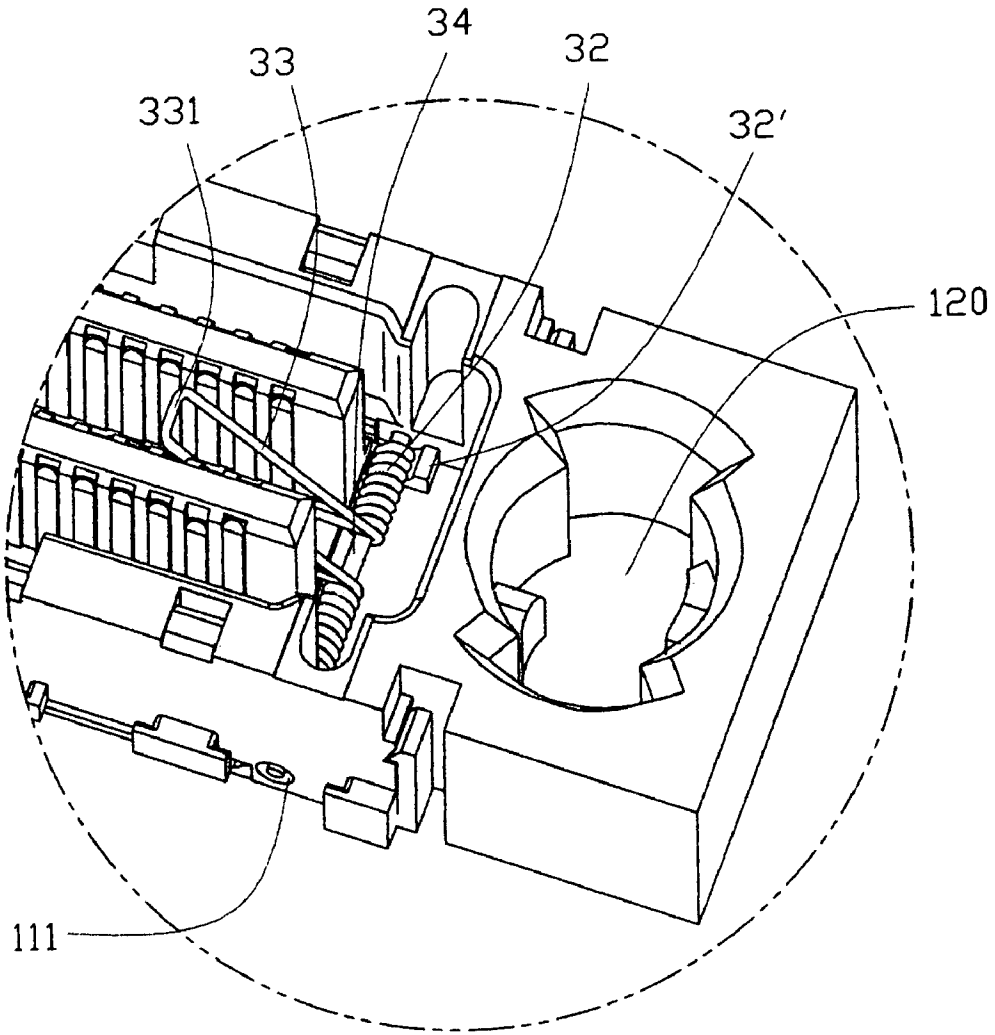
FIG. 4 is a partial magnified view of the connector of FIG. 1.
Figure 5:
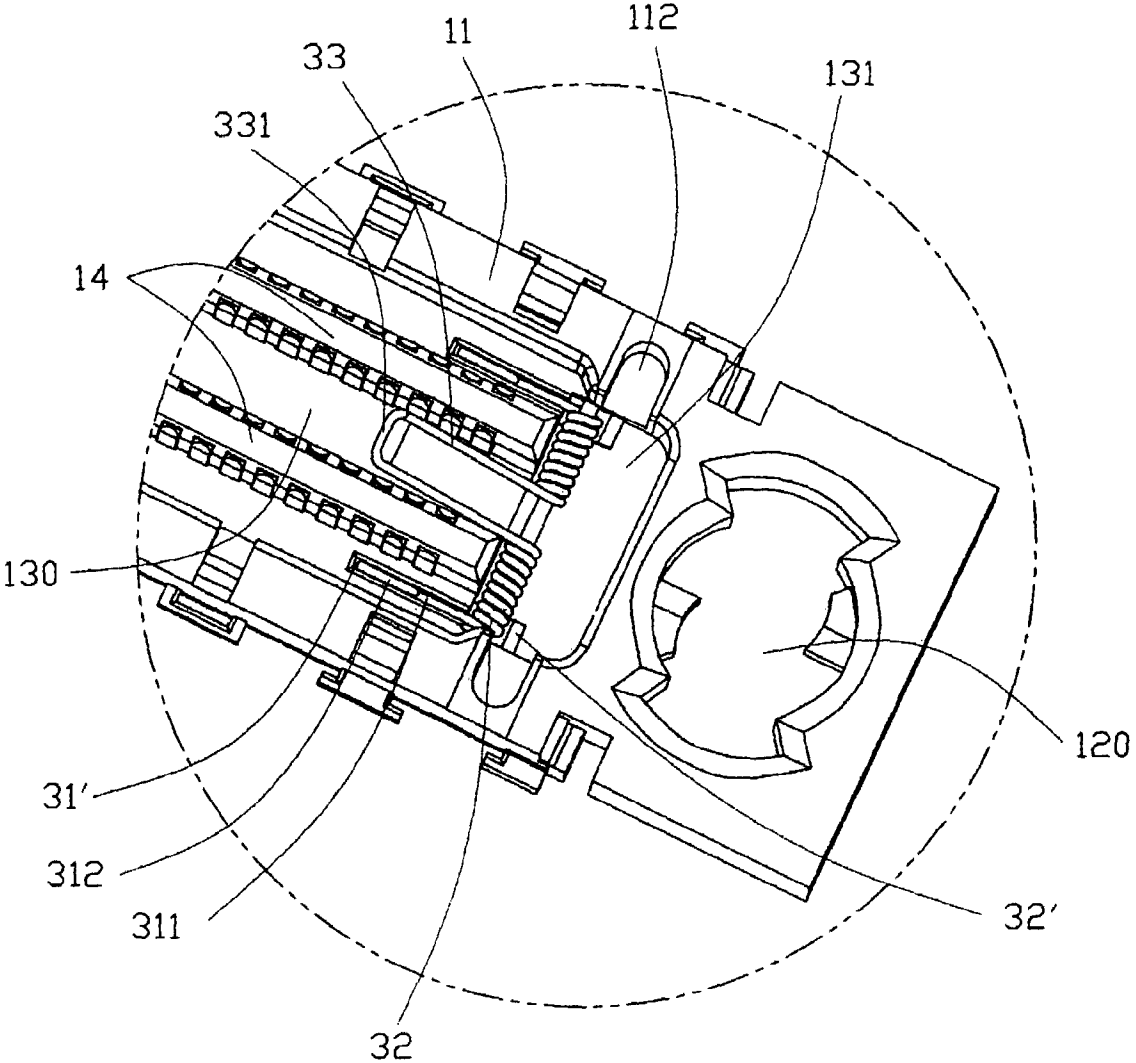
FIG. 5 is a partial magnified view of the connector of FIG. 2.
Figure 6:
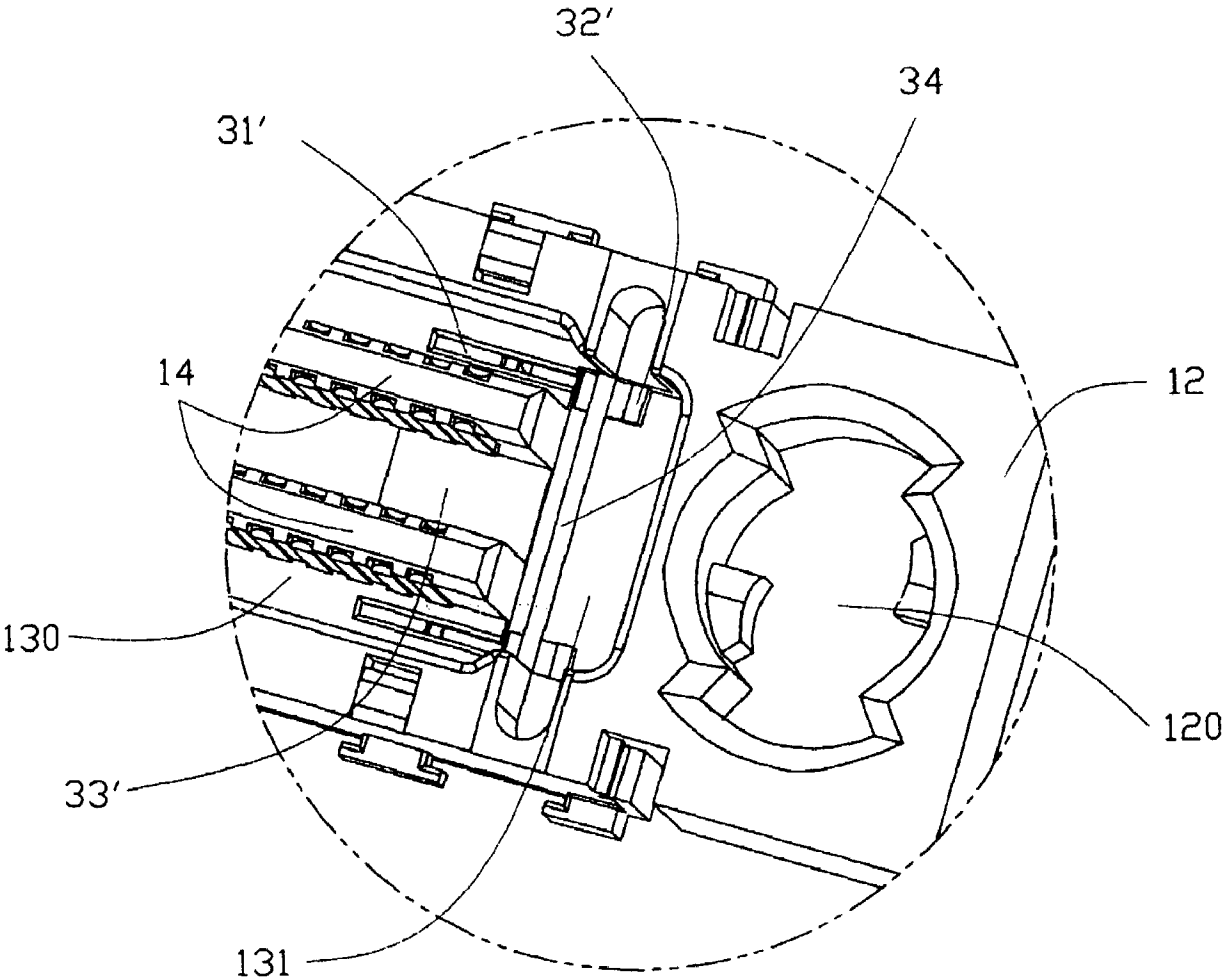
FIG. 6 is a view similar to that of FIG. 5, but the spring means is removed.

As the housing 1 is of a symmetrical structure, we will take one half thereof in the right to detailedly describe the arrangement of the elastic means 3 in the housing 1. Referring to FIGS. 4–6, the elastic means 3 is placed into the mating cavity 13 with the coil spring 32 disposed in the receiving room 131 to lie perpendicularly by the end of the tongues 14, the shaft member 33 extending into the space between the two tongues 14, and the retaining legs 31 respectively extending into spaces between tongues 14 and sidewalls of the mating cavity 13.

As best shown in FIG. 6, for fitly receiving the elastic means 3, the bottom 130 of the mating cavity 13 defines a pair of elongated slots 31' for accommodating the retaining legs 31, and a recess 33' for receiving the shaft member 33 after the shaft member 33 rotated to lying down. Each of the elongated slots 31' is of a step-like shape comprising a deep section and a shallow section respectively corresponding to the foot section 311 and the end section 312 of the retaining leg 31. As it is the end section 312 that abuts against the housing 1 thereunder to take the pressure when the shaft member 33 is under a pressure, to dispose the end section 312 in the shallow section to be a little remoter from an under surface of the housing 1 will prevent the housing 1 thereunder from breaking in some sense. Wherein the deepness of the shallow section of the elongated slots 31' is just right to make the end section 312 received therein be flush with the bottom 130 of the mating cavity 13. Alike, the recess 33' has a size of deepness to make the shaft member 33 lying therein be flush with the bottom 130 of the mating cavity 13. Otherwise, the receiving room 131 is deepened a little from the mating cavity 13 to make the coil spring 32 lying thereon be flush with the bottom 130 of the mating cavity 13. Thus, as best shown in FIG. 5, the elastic means 3 is disposed as if it is embedded in the bottom 130 of the mating cavity 13 only to expose a top surface while the shaft member 33 thereof lying down. That makes a whole bottom surface of the mating cavity 13 approximately be a flat surface. So that when the shutter 4 sinks in the mating cavity 13 to the bottom 130 thereof, the shutter 4 can abut upon the bottom 130 closely, detail of which will be described hereafter.

In addition, for preventing the coil spring 32 from rolling, there is a pair of brackets 32' formed in the receiving room 131 for holding the coil spring 32. For strengthening the coil spring 13, an elongated axis 34 is inserted from a through hole 111 in one side of the housing 1 into the hollow center of the coil spring 32 defined by the coils thereof to be retained in the other side of the housing 1, as best shown in FIG. 4.

Figure 3:
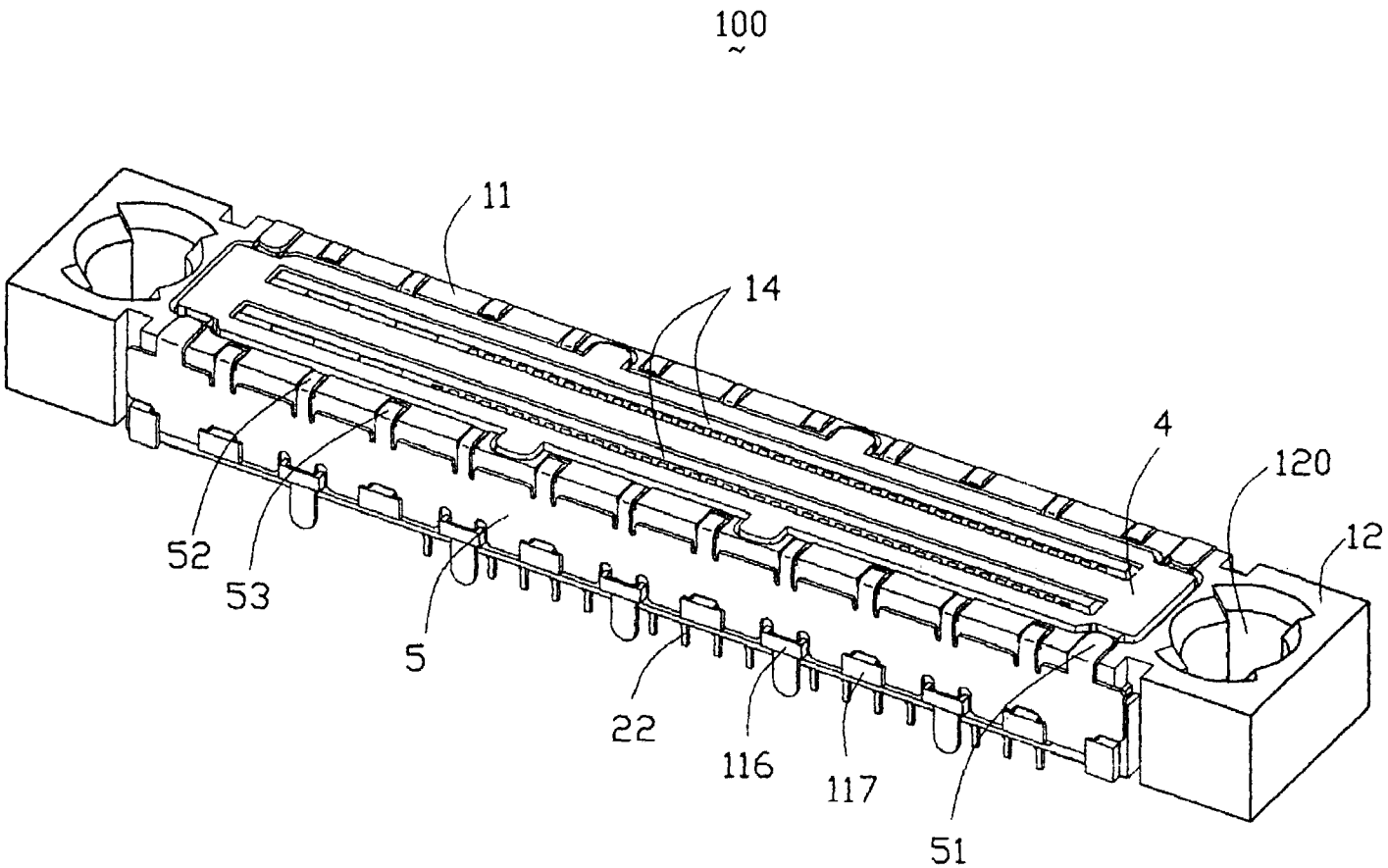
FIG. 3 is an assembled perspective view of the connector of FIG. 1.

Referring to FIG. 1 again, the shutter 4 is a longitudinal, flat plate comprising a main plate 41, two pairs of middle-ears 43 extending sideward from middle part of the main plate 41, and two pairs of end-ears 42 respectively extending sideward from ends of the main plate 41. The main plate 41 defines a pair of passageways 44 for the tongues 14 to pass through. Corresponding to the ears 42, 43 of the shutter 4, the housing 1 defines guiding apertures 112, 113 in the sidewalls of the mating cavity 13. The guiding apertures 112, 113 communicate with the mating cavity 13 and have the same deepness with the mating cavity 13. As shown in FIG. 3, when the shutter 4 covers the mating cavity 13 of the housing 1, the ears 42, 43 are respectively received in the guiding apertures 112, 113.

Figure 8:
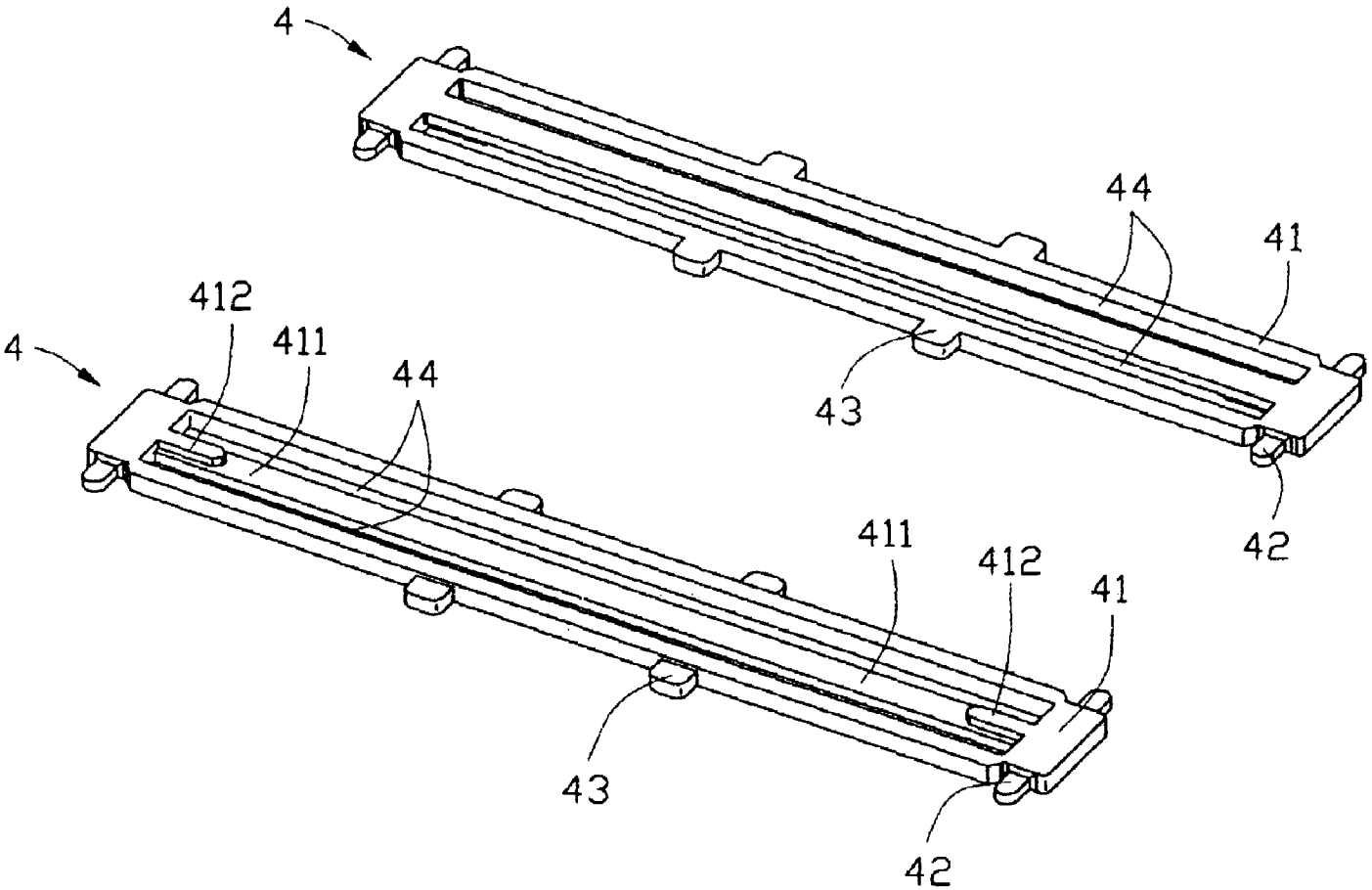
FIG. 8 shows the shutter of FIG. 1 from two opposite perspectives respectively.

Referring to FIG. 8 together, the forming of the passageways 44 divides the main plate 41 into three stripes. A bottom surface 411 of the middle stripe serves as a slideway for the free ends 331 of the shaft members 33 while the shutter 4 sinking. On the surface 411 there is a pair of ribs 412 formed at ends thereof. The ribs 412 hold the free ends 331 of the shaft members 33 to stop them from sliding when the shutter 4 is covering the mating cavity 13 before sinking.

Now we can see that the shutter 4 supported by the shaft member 33 of the elastic means 3 is covering the mating cavity 13 of the connector 100 primitively. Then when the mating connector is brought to engage with this connector 100, a mating portion of a mating connector is plugged into the mating cavity 13 to press the shutter 4 to sink into the mating cavity 13 to the bottom 130 thereof, to expose the contact portions 21 of the terminals 2 on the tongues 14 to electrically contact conductors of the mating connector. In this process, the shaft member 33 is pressed to rotate down till it flatly lie in the recess 33' on the bottom 130 of the mating cavity 13. The shaft member 33 flatly lies thereon, occupying a very little space between the sunk shutter 4 and the housing 1 thereunder, until the mating connector is withdrew. When the mating connector is withdrew, the mating cavity 13 is not plugged in, the shutter 4 and the shaft member 33 of the elastic member 3 return to the primitive state. During the whole process, the ears 42, 43 respectively moving up and down in the guiding apertures 112, 113 corresponding to floating and sinking of the shutter 4.

Referring to FIGS. 1 and 3, the connector 100 further comprises a shield shell 5 attached to exterior sides of the main portion 11 of the housing 1 with its legs 54 and notches 55 respectively engaging with slots 116 and tubers 117 on the housing 1. The shield shell 5 has a plurality of hook-like fingers 52, 53 to hitch the housing 1 respectively at recesses 114, 115 on the housing 1, and two pair of bars 51 respectively at ends thereof, bending over the apertures 112 of the housing 1 to stop the end ears 42 from jumping out while the shutter 4 being urged to float up by the shaft member 33, thereby to secure the shutter 4 to cover the mating cavity 13 of housing 1.

The disclosure is illustrative only, changes may made in detail, especially in matter of shape, size, and arrangement of parts within the principles of the invention. For example, the elastic portion 32 of the elastic means 3 would be simply a flexible arc or the like joining the retaining portion 31 and the shaft member 33.

What is claimed is:

1. An electrical connector comprising:

a housing defining a mating cavity;

a plurality of terminals loaded in the housing and each having a contact portion exposed in the mating cavity;

a shutter covering the mating cavity in a first position thereof relative to the housing and being sinkable into the mating cavity to a second position to expose the contact portions of the terminals; and an elastic means urging the shutter from the second position to the first position, the elastic means provided with an elongated shaft member aslant extending into the mating cavity to support the shutter in the first position, the shaft member sandwiched between the shutter and the housing while the shutter is at the second position.

2. The electrical connector as described in claim 1, further comprising a shell attached to a periphery of the housing, the shell having a bar for securing the shutter in the first position to prevent the shutter from jumping out of the mating cavity.

3. The electrical connector as described in claim 1, wherein the housing defines a guiding channel with an entry thereof sealed by the shell and the shutter is formed with a guiding ears moving back-and-forth in the guiding channel.

4. The electrical connector as described in claim 1, wherein the shaft member has a free end to slide on the shutter while the shutter sinking and the shaft member rotating.

5. The electrical connector as described in claim 4, wherein the shutter has a securing portion to hold the free end of the shaft member against from sliding while the shutter is in the first position.

6. The electrical connector as described in claim 1, wherein the elastic means is disposed in the mating cavity.

7. The electrical connector as described in claim 1, wherein the shaft member extends from a middle of a coil spring.

8. The electrical connector as described in claim 1, wherein the mating cavity has at least a tongue protruding from a bottom thereof, and the shutter defines a passageway for the tongue to pass through while the shutter sinking.

9. An electrical connector comprising:

an insulative housing defining an elongated receiving cavity with at least one mating tongue extending therein;

a plurality of contacts disposed on at least on surface of said mating tongue;

a shutter assembled to the housing and movable back and forth in said receiving cavity along a mating direction, said shutter defining an elongated slot dimensioned compliant wit a cross-section of said mating tongue; and a resilient device urging said shutter toward a mating face of the housing to shield the receiving cavity when no complementary connector is mated; wherein said resilient device defines a deflectable member essentially swinging around a pivotal axis which extends in a horizontal direction parallel to the mating face while perpendicular to the mating direction, and wherein said deflectable member abuts against a back face of the shutter in a parallel relation when said shutter is fully pushed to a final position in the receiving cavity.

10. The connector as claimed in claim 9, further including a guidance device on the shutter for assurance of no tilting of the shutter during back-and-forth movement along said mating direction.

11. The connector as claimed in claim 10, further including a complementary guidance device on the housing for interengaging the guidance device.

12. An electrical connector comprising:

an insulative housing defining an elongated receiving cavity with at least one mating tongue extending therein;

a shutter comprising a back face assembled to the housing and movable back and forth in said receiving cavity along a mating direction, said shutter defining an elongated slot dimensioned compliant with a cross-section of said mating tongue; and a resilient device comprising a coil spring extending in a horizontal direction parallel to the mating face while perpendicular to the mating direction, a retaining leg extending from the coil spring and abutting on a bottom face of the receiving cavity, and a supporting member swingably extending from the coil spring and angularly disposed between the shutter and the bottom face of the receiving cavity for supporting the shutter toward a mating face of the housing to shield the receiving cavity when no complementary connector is mated.

13. The connector as claimed in claim 12, wherein the supporting member has a free end capable of sliding against the back face of the shutter.

14. The connector as claimed in claim 12, wherein the supporting member abuts against the back face of the shutter in a parallel relation when said shutter is fully pushed to a final position in the receiving cavity.

15. The connector as claimed in claim 12, wherein a the receiving cavity defines a room for fitly receiving the coil spring portion of the resilient device.

* * * * *